US006273265B1

(12) United States Patent
Greenwalt

(10) Patent No.: US 6,273,265 B1
(45) Date of Patent: Aug. 14, 2001

(54) MAGNETICALLY ENHANCED GRAVITY SEPARATOR

(75) Inventor: Richard B. Greenwalt, Danville, CA (US)

(73) Assignee: Bechtel Corporation, San Francisco, CA (US)

( * ) Notice: Subject to any disclaimer, the term of this patent is extended or adjusted under 35 U.S.C. 154(b) by 0 days.

(21) Appl. No.: 09/614,390

(22) Filed: Jul. 12, 2000

Related U.S. Application Data

(63) Continuation-in-part of application No. 09/352,483, filed on Jul. 13, 1999.

(51) Int. Cl.[7] ..... B03C 1/00

(52) U.S. Cl. ..... 209/212; 209/132; 209/133; 209/155; 209/213; 209/223.1

(58) Field of Search ..... 209/132, 133, 209/155, 212, 213, 223, 478

(56) References Cited

U.S. PATENT DOCUMENTS

| | | | | |
|---|---|---|---|---|
| 2,615,572 | | 10/1952 | Hodge | 209/211 |
| 3,575,293 | | 4/1971 | Nelson | 209/458 |
| 3,875,061 | | 4/1975 | Palma | 210/223 |
| 4,313,543 | * | 2/1982 | Paterson | 209/212 |
| 4,842,721 | | 6/1989 | Schloemann | 209/212 |
| 4,941,969 | | 7/1990 | Schönert et al. | 209/39 |
| 5,191,981 | * | 3/1993 | Young | 209/39 |
| 5,192,423 | | 3/1993 | Duczmal | 209/164 |
| 5,205,414 | | 4/1993 | Martinez | 209/8 |
| 5,224,604 | | 7/1993 | Duczmal et al. | 209/12 |
| 6,063,303 | * | 5/2000 | Ohtaki | 252/62.54 |

FOREIGN PATENT DOCUMENTS

1373445 A1 2/1988 (SU) .

* cited by examiner

*Primary Examiner*—Donald P. Walsh
*Assistant Examiner*—Mark J. Beauchaine
(74) *Attorney, Agent, or Firm*—Townsend and Townsend and Crew LLP

(57) ABSTRACT

The performance of a gravity separator is enhanced by providing a magnetic material on the separation surface of the gravity separator. A magnetically enhanced gravity concentration/separation apparatus is provided for enhancing separation of a target feed material from remaining feed materials in a feed mixture having a transport medium and feed materials which comprise the target feed material and the remaining feed materials. The target feed material is magnetic and generally has a higher specific gravity than any magnetic feed materials contained in the remaining feed materials. The separating apparatus comprises a gravity separator including a separation surface on which to flow the feed mixture. The separation surface includes a magnetic separator material thereon to provide a magnetic field producing a sufficiently high magnetic attraction to enhance separation of the target feed material from the remaining feed materials in the feed mixture as the feed mixture flows over the separation surface carrying the remaining materials past the separation surface. The magnetic attraction of the magnetic field provided by the magnetic separator material on the separation surface is sufficiently low to at least substantially avoid accumulating magnetic feed materials contained in the feed mixture on the separation surface.

25 Claims, 3 Drawing Sheets

MAGNETICALLY ENHANCED GRAVITY SEPARATOR

This application is a continuation-in-part of and claims the benefit of U.S. patent application Ser. No. 09/352,483, filed Jul. 13, 1999, which is incorporated herein by reference in its entirety.

FIELD OF THE INVENTION

The present invention relates generally to gravity concentration or gravity separation and, more particularly, to a method and apparatus for enhancing the performance of a gravity separator using magnetic fields.

BACKGROUND OF THE INVENTION

A variety of gravity separators have been developed for use in concentrating/separating various minerals and particles based on their relative specific gravity. Differences in the specific gravities of the different materials making up the feed mixture are used to achieve the separation of high specific gravity materials from the low specific gravity materials. Gravity separators include, but are not limited to, launders, riffles, hydroseparators, thickeners, clarifiers, elutriators, jigs, Eirich cones, spiral separators, hydrocyclones, hydrosizers, and settling cones. Although the primary criteria used to select a specific type of separator is the size and the physical nature of the materials to be separated, other factors may enter into the selection process including the desired rate of separation, the total quantity of material to be separated (i.e., short term versus long term needs), the size of the facility in which the separator is to be used, and the cost. The separations are conducted in a fluid, such as water or air, that acts both as a separation medium and as a transport medium.

Many different approaches have been taken to improving the concentration/separation efficiency and/or general operation of gravity separators. For example, U.S. Pat. No. 4,384,650 discloses a modification to a simple spiral separator that is designed for use with materials that do not vary greatly in specific gravity. The disclosed separator is similar to a conventional spiral separator in that it is comprised of a plurality of helical troughs or spirals mounted to an upright column. Unlike a conventional separator in which the separator trough is relatively uniform along its entire length, the trough of the disclosed separator includes a channel along the outer portion of the trough. The channel is narrow and deep near the top of the separator, becoming progressively wider in order to maintain pulp flow and avoid coarse and/or less dense particles from becoming stationary or stranded.

Another method of enhancing the performance of a separator is to combine conventional gravity separation with magnetic separation. For example, U.S. Pat. No. 4,565,624 and related U.S. Pat. No. 4,659,457 disclose retrofitting a conventional gravity separator with magnets. The disclosed systems use magnets mounted beneath the separation surface (e.g., trough or sluice, etc.) to enhance the separation of magnetic or weakly magnetic minerals from feed materials. In order to prevent build-up of magnetic or weakly magnetic particles on the flow surface, the magnetic field is varied over time. Disclosed techniques of varying the magnetic field include the use of electromagnets and altering the positions of permanent magnets relative to the flow surface.

U.S. Pat. No. 5,193,687 discloses a gravity-magnetic separation system in which permanent magnets are retrofitted under a metal separation trough such as the spiral cast-iron trough utilized in a conventional Humphreys spiral type gravity separator. The permanent magnets of the disclosed system are intended to be sufficiently strong to overcome the shielding effect of the trough structure while being weak enough to prevent excessive build-up of the magnetic material on the separation surface. In one embodiment of the system, the permanent magnets are comprised of neodymium, boron, and iron. In another embodiment, the magnets are comprised of cobalt and samarium. The patent also discloses the use of electromagnets of suitable strength.

U.S. Pat. No. 5,205,414 discloses a process for improving the recovery of non-magnetic heavy minerals in a gravity-magnetic separator. Specifically, the disclosed process adds magnetic material, for example ilmenite, magnetite, or iron filings, to the feed material of a gravity-magnetic separator. In one embodiment, the system is used in the processing of iron ore to recover magnetite as well as hematite. In another embodiment, the system is used in the treatment of heavy mineral sand ore containing rutile, zircon, and ilmenite.

SUMMARY OF THE INVENTION

The present invention is related to a system for enhancing the concentration performance of a gravity separator by providing a magnetic material on the separation surface of the gravity separator. The apparatus provides magnetically enhanced gravity separation without concern for the shielding effects of the separation structure (as in the case where magnets are mounted at the bottom side of the separation structure disposed on the opposite side from the separation surface) and is easily adaptable to any type of gravity separation system as desired.

In a conventional gravity separator, high specific gravity feed materials are separated from low specific gravity feed materials in a feed mixture which includes the feed materials contained in a transport medium. In a separator fabricated in accordance with specific embodiments of the present invention, the magnetic separator material on the separation surface improves the separation of magnetic, high specific gravity materials from remaining materials in the feed mixture such as non-magnetic, low specific gravity materials.

One aspect of the invention is directed to a magnetically enhanced gravity separating apparatus for enhancing separation of a target feed material from remaining feed materials in a feed mixture having a transport medium and feed materials which comprise the target feed material and the remaining feed materials. The target feed material is magnetic and generally has a higher specific gravity than any magnetic feed materials contained in the remaining feed materials. The separating apparatus comprises a gravity separator including a separation surface on which to flow the feed mixture. The separation surface includes a magnetic separator material thereon to provide a magnetic field producing a sufficiently high magnetic attraction to enhance separation of the target feed material from the remaining feed materials in the feed mixture as the feed mixture flows over the separation surface carrying the remaining materials past the separation surface. The magnetic attraction of the magnetic field provided by the magnetic separator material on the separation surface is sufficiently low to at least substantially avoid accumulating magnetic feed materials contained in the feed mixture on the separation surface.

In some embodiments, the magnetic separator material on the separation surface is formed by attaching a magnetic layer on the separation surface. In other embodiments, the magnetic separator material on the separation surface is formed by coating the separation surface with a magnetic coating. The magnetic layer may comprise a magnetic ceramic material. In a specific embodiment, the magnetic coating comprises a ceramic paint. The separator is selected from the group of separators consisting of launder separators, spiral separators, cone separators, shaker tables, lamella separators, and hydroseparators.

Another aspect of the invention is directed to a magnetically enhanced gravity separating apparatus for enhancing separation of a target feed material from remaining feed materials in a feed mixture having a transport medium and feed materials which comprise the target feed material and the remaining feed materials. The target feed material is magnetic and generally has a higher specific gravity than any magnetic feed materials contained in the remaining feed materials. The separating apparatus comprises a gravity separator including a separation surface on which to flow the feed mixture. The separation surface includes a magnetic separator material formed thereon prior to flowing the feed mixture thereover to provide a magnetic field producing a sufficiently high magnetic attraction to enhance separation of the target feed material from the remaining feed materials in the feed mixture as the feed mixture flows over the separation surface carrying the remaining materials past the separation surface.

Another aspect of the invention is directed to a method for enhancing separation of a target feed material from remaining feed materials in a feed mixture having a transport medium and feed materials which comprise the target feed material and the remaining feed materials. The target feed material is magnetic and generally having a higher specific gravity than any magnetic feed materials contained in the remaining feed materials. The method comprises providing a gravity separator including a separation surface having a magnetic separator material to provide a magnetic field producing a sufficiently high magnetic attraction to enhance separation of the target feed material from the remaining feed materials in the feed mixture as the feed mixture flows over the separation surface carrying the remaining materials past the separation surface. The magnetic attraction of the magnetic field provided by the magnetic separator material on the separation surface is sufficiently low to at least substantially avoid accumulating magnetic feed materials contained in the feed mixture on the separation surface. The method further comprises flowing the feed mixture over the separation surface.

In some embodiments, the magnetic separator material is provided on the separation surface prior to flowing the feed mixture thereover. The magnetic separator material may be formed on the separation surface by attaching a preformed magnetic layer on the separation surface. The magnetic separator material may be formed on the separation surface by coating the separation surface with the magnetic separator material prior to flowing the feed mixture thereover. In specific embodiments, the magnetic separation surface is coated onto the separation surface by painting, spraying, lining, thermal spraying, or the like.

Although the size, shape, and location of the magnetic separator material of the present invention are application specific, the magnetic separator materials are disposed on the actual separation surface rather than below or next to the separation surface. Accordingly, the feed materials to be separated pass directly over the magnets thereby providing enhanced interaction of the magnetic field with the feed materials and eliminating problems associated with magnetic shielding by the separation substrate.

A further understanding of the nature and advantages of the present invention may be realized by reference to the remaining portions of the specification and the drawings.

DESCRIPTION OF THE SPECIFIC EMBODIMENTS

Figure 1:
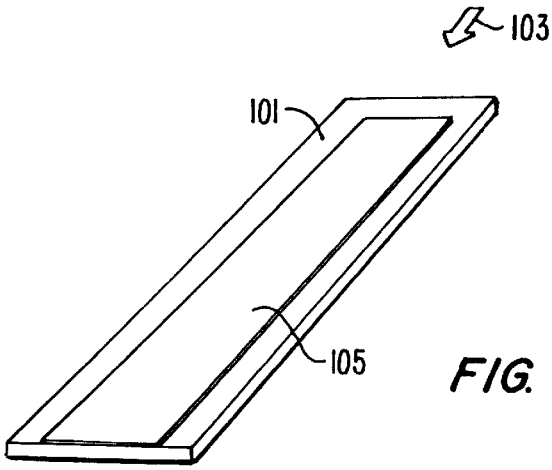
FIG. 1 is a perspective view of an embodiment of a magnetically enhanced gravity separator illustrating the general concept of the present invention.

FIG. 1 illustrates the general concept of the present invention. As shown, a separation surface 101 is downwardly sloped for use in any of a variety of gravity separation systems. It is understood that separation surface 101 can be flat, in the shape of a trough, in the shape of a baffle, in the shape of a cone, in the shape of a cylinder, or in another form. Furthermore, separation surface 101 can be sloped, vertically positioned, or otherwise positioned. A feed mixture including feed materials contained within a transport medium such as air or water enters the separator in a direction 103. The separation surface 101 includes a layer of magnetic material 105, which may be formed by painting, coating, or lining the separation surface 101 with a magnetic material, or by attaching a magnetic sheet or strip or a flexible magnet to the separation surface 101, or by other available methods. The magnetic layer or coating 105 conforms to the separation surface 101. For instance, a flexible magnet can be easily shaped to conform to separation surface 101. It is understood that the placement of magnetic layer 105 as well as the relative sizes of both magnetic layer 105 and surface 101 shown in FIG. 1 are for illustrative purposes only and that other sizes and locations are envisioned by the inventor. Typically the size, shape, and location of magnetic layers 105 are application specific.

The magnetic material in the magnetic layer 105 is selected at least in part based on the desired field strength. The field strength of the magnetic material is typically in the range of about 400 to about 1200 Gauss, and more desirably in the range of about 1000 to about 1200 Gauss. It should be understood that the desired field strength is application specific and therefore can fall outside of either of these ranges. For example, if the feed mixture in a specific application includes ferromagnetic materials that exhibit strong magnetic properties, the magnetic separator material on the separation surface would produce a relatively weak magnetic field. In this instance the magnetic field of the selected magnetic separator material for the magnetic layer is desirably sufficiently large to enhance the gravity separation while not being so large as to cause a build-up of the ferromagnetic materials on the separation surface which could lead to the disruption of the feed material flow. In another example in which the feed materials are limited to paramagnetic and diamagnetic materials, the selected magnetic separator material desirably exhibits a much larger magnetic field, on the order of about 1000 to about 1200 Gauss, thereby providing sufficient influence over the weakly magnetic paramagnetic material. In some embodiments, the magnetic separator material is a ceramic material, such as barium ferrite and strontium ferrite.

The perception in the industry, prior to the present invention, has been that a magnet retrofitted to a gravity separator cannot be placed within the flow of the feed mixture as it will unduly disrupt the flow, and thus the effectiveness, of the gravity separator. Accordingly, if the gravity separation surface at the desired location for the magnet is made of fiberglass reinforced plastic or other non-magnetic material, a magnet according to the prior art is typically either attached directly to the bottom surface, for example when an electromagnet is used (e.g., U.S. Pat. Nos. 4,565,624 and 4,659,457) or placed in close proximity to the surface, for example when a permanent magnet is used (e.g., U.S. Pat. Nos. 4,565,624 and 4,659,457). If the gravity separation surface at the desired location for the magnet is made of iron or other magnetic material, the selected magnet must either be of sufficient field strength to overcome the shielding effects of the separation structure (e.g., U.S. Pat. No. 5,193,687) or the portion of the separation surface lying directly over the magnet must be replaced with a non-magnetic material as suggested in U.S. Pat. No. 4,565,624.

In contrast to the prior art and the perceptions of the industry, the inventor has found that a permanent magnet or a layer of magnetic material of sufficient field strength can be attached, applied, painted, coated, lined, or otherwise formed directly on the gravity separation surface as illustrated in FIG. 1. If the thickness of the magnetic layer is sufficiently small (e.g., typically between about 0.5 and about 3 millimeters thick and more desirably between about 0.5 and about 1 millimeter thick), the flow of the feed mixture is, at most, minimally affected. The shielding effects of the separation structure are completely avoided. Furthermore, there is no need to replace a portion of the separation surface due to wear (i.e., as in the case of a magnetic separation surface). Instead, the magnetic separator material on the separation surface can be reapplied by repainting or recoating the surface with a magnetic material or by reattaching a magnetic layer onto the surface, if it becomes worn or if a different magnetic field strength is desired. As used herein, a magnetic layer on the separation surface is used generally to refer to a layer of magnetic material which is attached, applied, painted, coated, lined, or otherwise formed directly on the separation surface.

Magnetic Strip or Sheet

One way to form a separation surface with a magnetic layer or lining is by attaching a magnetic layer 105 such as a flexible magnet onto the separation surface 101. Techniques for fabricating flexible magnets, such as magnet 105 of FIG. 1, are well known by those of skill in the art and therefore only minimal description is provided herein. Typically a magnetic material, preferably in the form of a powder, is embedded within a thin flexible material. Suitable flexible materials include, but are not limited to, elastomers (e.g., natural or synthetic rubber) and plastics (e.g., thermoplastic and thermosetting plastics). Both the specific magnetic material (e.g., strontium ferrite grains, neodymium and praseodymium ferrite powders, and nickel-cobalt metal powders) as well as the density of magnetic material to be embedded into the flexible material are selected on the basis of the desired magnetic field strength.

The flexible magnets of the present invention can be formed in the size and shape desired to fit a preselected gravity separator. Alternately, the desired size and/or shape can be cut from a sheet or strip of a pre-formed, flexible magnetic material, thereby reducing fabrication costs through the use of commercially available, non-custom materials. Such commercially available materials can be readily obtained in small strips, e.g., 4 millimeters wide, or in large sheets, e.g., 1.3 meters wide by 60 meters long. The thickness of such commercially available material ranges from approximately 0.5 millimeters to several millimeters. In the preferred embodiment of the invention, the thickness of the magnetic member is in the range of 0.5 to 1 millimeter.

According to this embodiment of the invention, the flexible magnet is attached to the separation surface. If the separation surface is a metallic surface that is sufficiently magnetic in nature (e.g., iron, carbon steel, etc.), the magnet can be magnetically attached to the separation surface. If the separation surface is non-magnetic, the flexible magnetic member is preferably attached using an adhesive, although other methods can be used. The flexible magnets of the present invention can be easily formed to fit, and installed within, virtually any gravity separator at minimal cost. Furthermore, the flexible magnets can be easily replaced if they become worn or if a different magnetic field strength is desired.

Magnetic Paint or Coating

Another way to form a separation surface with a magnetic layer is by applying a magnetic coating onto the separation surface by painting, spraying, or the like. For instance, magnetic materials such as magnetic ceramic materials can be provided as pigment or filler in a magnetic ceramic paint with binders/suspension agents, vehicles, and film formers much like commercial house paint. The binders glue the main ingredient material to the separation surface on which the paint is applied. The binders may be organic, inorganic, or a mixture of both, depending on the desired coating. A suspension agent, often the same as the binder, is used to hold the main ingredient in a suspension to keep it from setting out. The vehicle is the liquid that is used for the paint, generally water or a solvent. The pigment or filler is the main component of the paint that will be left after the paint is dried, and comprises the magnetic ceramic material. The magnetic ceramic paint can vary in the specification for different temperatures and atmospheres (vacuum, inert, etc.). The coefficient of thermal expansion of the paint may be matched to that of the separation structure, although it is generally not necessary to do so since paintable coatings are typically forgiving due to the way the magnetic ceramic material is bonded to the separation surface and the porosity of the coatings.

The magnetic ceramic paint can be applied by brushing, painting, spraying, or other methods. Thermal spraying, such as plasma spraying, is one method that may be used to apply a magnetic coating such as a magnetic ceramic coating onto the separation surface. The separation surface may be metallic or nonmetallic, such as fiberglass. Thermal spraying may involve creating a plasma with a plasma torch and spraying the ceramic magnetic powder through the plasma onto the separation surface. The technique of thermal spraying, including thermal spraying of ceramic materials, is known in the art.

EXAMPLE 1

Figure 2:
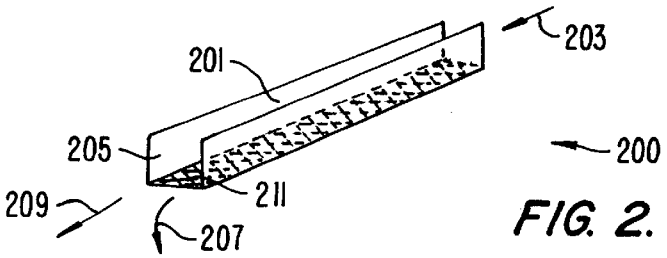
FIG. 2 is a perspective view of a magnetically enhanced launder separator according to another embodiment of the present invention.

FIG. 2 illustrates a magnetically enhanced launder separator 200. Launder separator 200 includes a trough 201 for separating feed materials contained in a feed mixture (i.e., feed materials and transport medium) entering the upper end of trough 201 along a direction 203. During conventional gravity separation, the material with the higher specific gravity will exit trough 201 closer to the separation surface of trough 201 than the material with the lower specific gravity. Thus the higher specific gravity material will concentrate in an area 207 while the lower specific gravity material will flow along a direction 209, further away from an end portion 205 of the separation surface. It is noted that the transport mechanism involving the use of a viscous transport medium, such as water, is such that larger size materials are more likely to exit trough 201 closer to the separation surface of trough 201 than smaller size materials of the same specific gravity. For materials of the same size, the difference in specific gravity is the primary mechanism for separation, and the higher specific gravity materials will be discharged closer to the separation surface than the lower specific gravity materials.

According to an embodiment of the present invention, a thin magnetic layer 211 is disposed on the separation surface of trough 201. The magnetic field emanating from magnetic layer 211 reduces the flow rate of any material within the feed material that exhibits magnetic susceptibility. Assuming that the material with the higher specific gravity is ferromagnetic or paramagnetic, the magnetic field emanating from magnetic layer 211 promotes and enhances the separation of ferromagnetic or paramagnetic material from the feed mixture.

In a specific example, not intended to limit the present invention, the feed mixture flowing in direction 203 includes both hematite, a paramagnetic material exhibiting a relatively low magnetic susceptibility, and non-magnetic quartz. The specific gravity of the hematite particles is 4.5 compared to 2.65 for the quartz particles. Therefore in a conventional gravity separation system, e.g., system 200 without magnetic layer 211, the hematite particles tend to migrate to the bottom of a particle suspension in advance of quartz particles of the same size and shape. Unfortunately coarse quartz particles can interfere with the settling of fine hematite particles of the same weight. The inclusion of magnetic layer 211 in system 200 enhances the separation of hematite, as the magnetic field attracts the paramagnetic hematite particles toward the separation surface regardless of size and shape. As the quarts particles remain unaffected by the magnetic field imposed by magnetic layer 211, separation of hematite from quartz is significantly improved.

In the specific example provided above, 100 percent of the hematite and quartz are commonly greater than 100 micrometers in diameter and up to at least 1.0 millimeter in diameter. Unfortunately, most gravity separators are not effective at particle diameters less than 100 micrometers due to water viscosity, adjacent particles, surface saltation, and the near Brownian movement of the finer particles in the transport medium. Thus a further benefit of the application of a magnetic layer to the gravity separator, according to the present invention, is that the capability of the separator is extended to particles as small as 10 micrometers in diameter.

EXAMPLE 2

Figure 3:
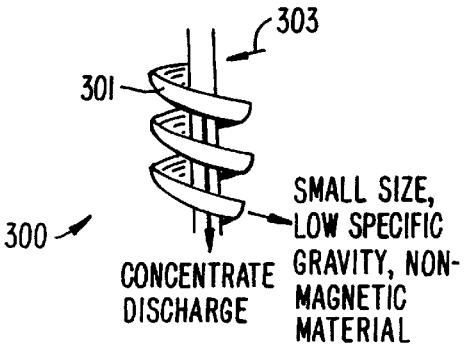
FIG. 3 is a perspective view of a magnetically enhanced spiral separator according to another embodiment of the present invention.
Figure 4:
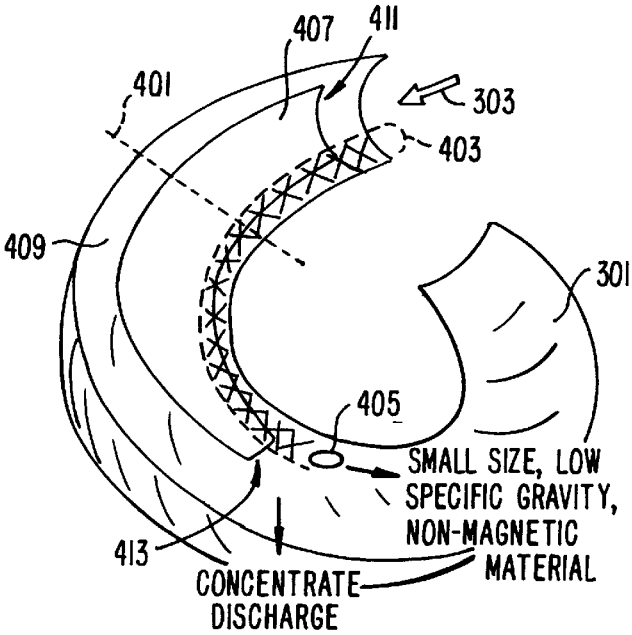
FIG. 4 is a perspective view of a single helical turn of the magnetically enhanced spiral separator shown in FIG. 3.
Figure 5:
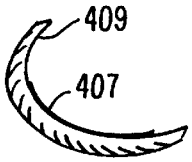
FIG. 5 is a cross-sectional view of the helical turn shown in FIG. 4.

FIGS. 3–5 illustrate an embodiment of the invention as applied to a spiral separator 300. Spiral separators are comprised of one or more helical turns 301 as shown in FIG. 3. A feed mixture including feed materials and a transport medium (typically water) enters an upper portion of the separator along a direction 303. In a conventional spiral separator, the gravity separation of feed materials is augmented by the centrifugal forces imparted on the feed as it travels in a generally downward direction through the helical turns.

FIG. 4 is an illustration of a single helical turn 301, and FIG. 5 is a cross-sectional view of helical turn 301 of FIG. 4 along a plane 401. During conventional use, as the feed mixture gradually flows along direction 303, the particles with the higher specific gravity will slow and descend to the bottom surface and become concentrated along an inner portion 403 of helical turn 301. The material concentrates are removed from the feed via one or more discharge ports 405 located on the inner rim of the turns while the lighter material continues downwardly through the separator until it is eventually removed at the bottom outlet of the separator (not shown). As is well known in the field, through control of the transport medium, shape and slope of the helical turns, number and placement of the discharge ports, etc., it is possible to control the type, i.e., specific gravity or density, of the material collected through the discharge ports.

According to an embodiment of the invention, and as illustrated in FIGS. 4 and 5, a magnetic layer 407 is disposed on the curved separation surface 409 of helical turn 301 ahead of each discharge port. A magnetic coating can be applied to form the magnetic layer, or a flexible magnet can be shaped to conform to the curvature of surface 409. If the magnetic layer is a magnet 407 it can either be magnetically attached to surface 409 if surface 409 is magnetic, or it can be bonded or otherwise attached to surface 409 if surface 409 is non-magnetic. As in the previous embodiment, magnetic layer 407 enhances the separation of magnetic, high specific gravity material from other feed materials such as a non-magnetic, low specific gravity material by further slowing down the desired material (i.e., the magnetic, high specific gravity material), thus making collection through discharge ports 405 more efficient. Additionally, in this embodiment the magnetic layer 407 helps to funnel the desired material to discharge ports 405.

As shown, the magnetic layer 407 both conforms to the curvature of surface 409 and is shaped such that the leading edge portion 411 is wider than the trailing edge portion 413. The shaping of the magnetic layer 407 provides a magnetic funneling effect, thereby funneling the magnetic concentrates towards discharge port 405. Alternately, the magnetic layer 407 can have a constant width. In still another alternative embodiment, the magnetic layer 407 can be semi-continuous, i.e., throughout a large portion of helical turn 301 such as between discharge ports, or continuous throughout the entire length of the spiral separator, i.e., throughout several helical turns 301. Note that in the alternative utilizing continuous magnets 407, ports 405 will be extended through the magnetic liner. The magnetic layer 407 may cover a portion or the entire separation surface 409.

EXAMPLE 3

Figure 6:
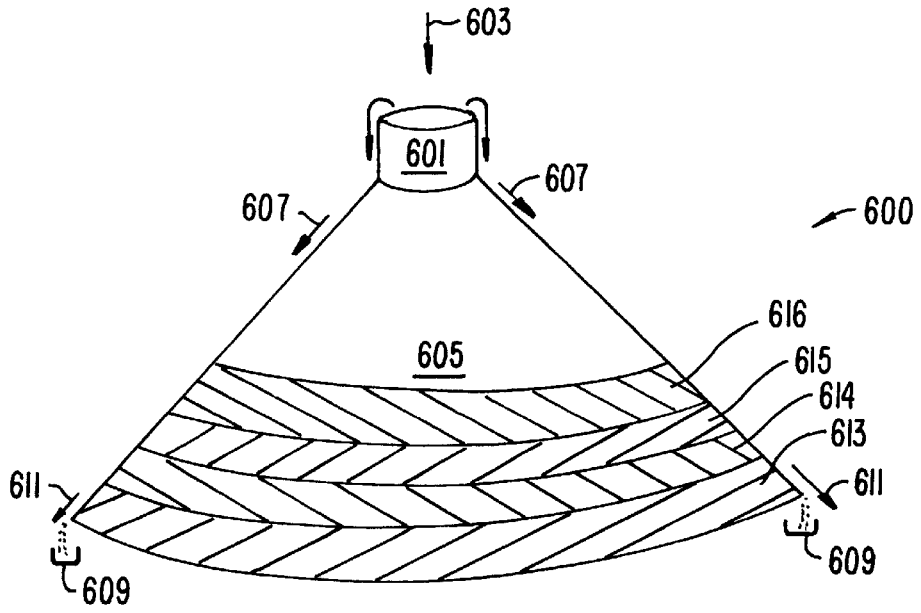
FIG. 6 is a perspective view of a magnetically enhanced cone separator according to another embodiment of the present invention.

FIG. 6 illustrates a cone separator 600. During conventional use, a feed mixture including the feed materials and transport medium is input into an upper portion 601 of the separator along a direction 603. The feed overflows portion 601 and travels along the surface of cone portion 605 in a direction 607. High specific gravity material tends to travel slowly along the surface of cone portion 605, falling off the cone edge into a circumferential trap or concentrate collector 609. Typically concentrate collector 609 is in the shape of a trough that encircles the bottom edge of cone portion 605. Lighter specific gravity material is swept off of cone portion 605 along a direction 611, thereby missing collector 609.

In a conventional cone separator, the material collected in collector 609 can be controlled to some extent by controlling the flow surface of the cone (e.g., different surface textures to alter the frictional component), the transport medium flow, the pulp density, the cone angle, the length of the cone portion, and the location of collector 609. Additionally, different density materials can be simultaneously collected by locating multiple collector troughs at varying distances from the cone edge.

In accordance with an embodiment of the invention, the outer surface of cone 605 is coated, at least in part, with a magnetic material that further slows down the velocity of magnetic feed materials, thereby enhancing the separation of magnetic, high density materials from other feed materials including non-magnetic, low density materials. In one embodiment, a flexible strip magnet 613 is attached to the lower portion of the separation surface of cone 605. In an alternate embodiment, multiple strip magnets 613–616 are used to cover a larger portion of the separation surface of cone 605, thus further enhancing the magnetic separation aspects of the design. Alternately, strip magnets 613–616 can be replaced with a sheet magnet covering the full cone. In other embodiments, the magnetic layer on the separation surface of the cone portion 605 is formed by painting, coating, or otherwise applying a magnetic material onto the separation surface.

EXAMPLE 4

Figure 7:
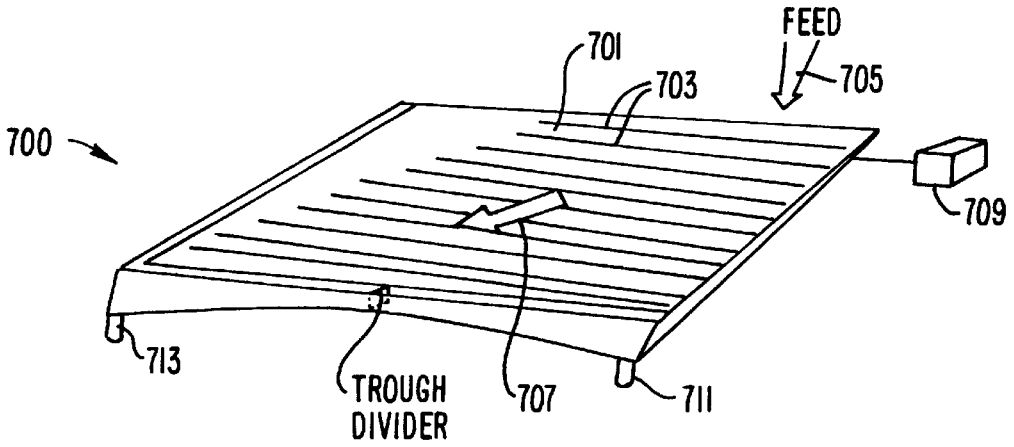
FIG. 7 is a perspective view of a magnetically enhanced shaker table according to another embodiment of the present invention.

FIG. 7 illustrates a shaker table 700 that is comprised of a table surface 701 and a plurality of parallel riffles 703. A feed mixture including feed materials and a transport medium such as water is introduced onto the table surface at a location 705 such that the direction of flow crosses riffles 703 in a direction 707. An oscillating motor 709 is coupled to table 700.

Figure 8:
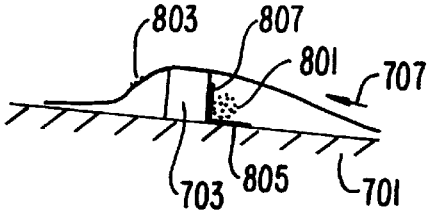
FIG. 8 is a cross-sectional view of one of the riffles of the magnetically enhanced shaker table shown in FIG. 7.

FIG. 8 is a cross-sectional view of a single riffle 703. As shown, the feed mixture travels in a direction 707, depositing the higher specific gravity material 801 along the leading edge of riffle 703 and allowing the lower specific gravity material 803 to pass over the riffle with the transport medium. Due to the combination of table slope and the impetus provided by the oscillation drive system 709, higher specific gravity material 801 travels along riffles 703. Therefore, the higher specific gravity material is collected by a collection system 713 while the lower specific gravity material along with the transport medium is collected by a collection system 711.

In a conventional shaker table, the specific gravity range of the concentrate collected by collection system 713 is controlled by varying riffle height, table slope, oscillation frequency and amplitude, and transport medium velocity.

In accordance with an embodiment of the invention, either the surface of separation table 701 between riffles 703 is covered with a magnetic layer 805, the leading edges of riffles 703 are covered with a magnetic layer 807, or both. Magnetic layers 805 and 807 enhance the effects of riffles 703 by attracting magnetic materials, thereby preventing those magnetic materials having a high specific gravity from passing over the riffles and being collected by collection system 711. The magnetic high specific gravity materials pass along the riffles 703 to the collection system 711.

EXAMPLE 5

Figure 9:
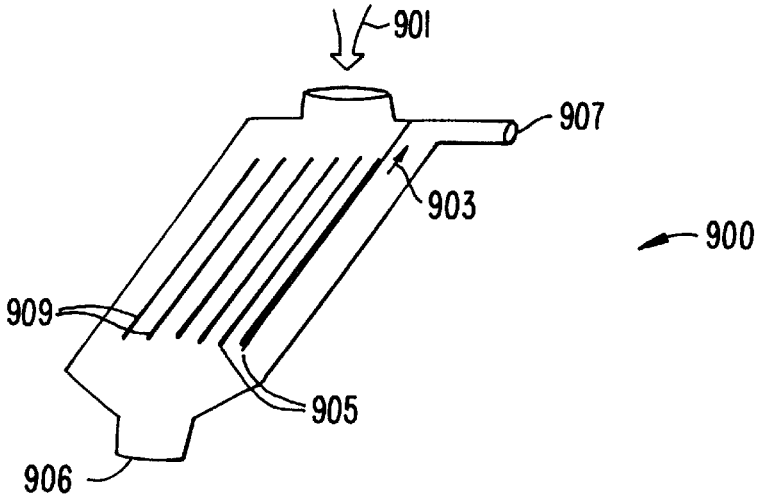
FIG. 9 is a perspective view of a magnetically enhanced lamella separation system according to another embodiment of the present invention.

FIG. 9 is an illustration of one configuration of a lamella separation system 900. Regardless of the exact configuration, the operation of a lamella separation system operates by the same principle of inputting the feed materials and transport medium in a direction 901 at a sufficient velocity to create upstream flow in a direction 903. By controlling the input and thus the upstream velocity, particles of the desired specific gravity are allowed to slide down one or more sloped lamella plates 905 and are collected through one or more concentrator ports 906. The lower specific gravity materials pass out of the separator with the transport medium through a separate overflow spout 907. The number of lamella plates 905 as well as the slope of the plates further controls the separation of the desired materials from the undesired materials.

In accordance with an embodiment of the invention, magnetic strips 909 are attached or coated onto the leading surfaces of lamella plates 905 to enhance the gravity separation of magnetic materials having a high specific gravity. In one preferred embodiment, the entire leading surface of each lamella plate 905 is covered by the magnetic layer 909, for example, through the use of a sheet magnet or multiple strip magnets, or by applying a magnetic coating through painting, spraying, or the like. Alternately, only a portion of the leading surface of one or more of lamella plates 905 is covered with the magnetic layer 909.

EXAMPLE 6

Figure 10:
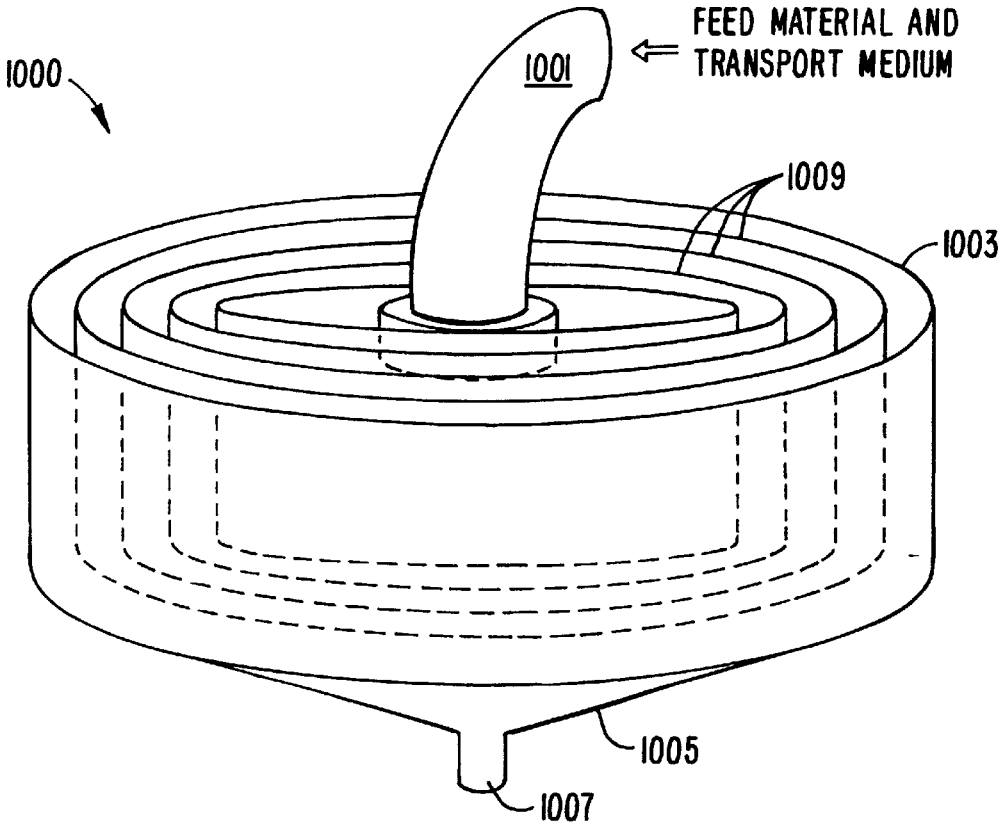
FIG. 10 is a perspective view of a magnetically enhanced hydroseparator according to another embodiment of the present invention.

FIG. 10 illustrates a hydroseparator 1000. In a conventional hydroseparator, a feed mixture including feed materials and transport medium is input through center port 1001. The feed materials and transport medium are input at a sufficient velocity to cause overflow along edge 1003. The overflow is caught in an overflow trough or other collection system (not shown). Low specific gravity material passes from the separator with the overflow while high specific gravity material collects at the bottom portion 1005, eventually passing from the system through discharge port 1007. In a conventional hydroseparator, one or more baffles 1009 may be used to aid in the separation process.

According to an embodiment of the invention, preferably baffles 1009 supported from a superstructure are comprised of flexible magnetic sheets, thus enhancing the separation of high density, magnetic materials from low density, non-magnetic materials. Alternatively, baffles can be of non-magnetic material with portions of one or both baffle surfaces being covered with magnetic coatings or flexible magnets or the like.

The examples provided above are only meant to be illustrative of the application of the invention to a variety of different gravity separator configurations. As will be understood by those familiar with concentration/separation systems, the present invention can be used with other separation systems by applying a thin magnetic layer to the separation surface thereby enhancing the separation performance of magnetic materials having a high specific gravity. As noted throughout the examples, the amount of magnetic separator material applied to the separation surface as well as the field strength associated with the magnetic material depends upon the desired application, i.e., the feed materials to be separated.

As previously noted, the present invention can enhance the performance of a separation system regardless of whether the material to be separated exhibits strong magnetic properties, i.e., ferromagnetics, or weak magnetic properties, i.e., paramagnetics. Preferably the field strength of the magnetic layer to be applied to the separation surface is selected on the basis of the magnetic properties of the feed materials to be separated, thus insuring that the selected magnetic separator material for the magnetic layer provides optimal enhancement of the gravity separation system. An example of a non-optimal magnetic layer would be a strong magnetic layer used with ferromagnetic materials, as this could lead to material accumulation on the separation surface rather than allowing the desired material to pass into the collection system. It should be noted that in some instances the material to be separated can first be passed through a conventional magnetic belt or drum separator to isolate and eliminate the ferromagnetic materials from the paramagnetic and diamagnetic materials. The paramagnetic materials and the diamagnetic materials can then pass through a gravity separator utilizing the magnetic layer covered separation surfaces per the present invention.

As will be understood by those familiar with the art, the present invention may be embodied in other specific forms without departing from the spirit or essential characteristics thereof. For example, magnetic layers can be applied to the separation surfaces of a variety of different separation techniques achieving the enhanced performance described above. Accordingly, the disclosures and descriptions herein are intended to be illustrative, but not limiting, of the scope of the invention which is set forth in the following claims.

What is claimed is:

1. A magnetically enhanced gravity separating apparatus for enhancing separation of a target feed material from remaining feed materials in a feed mixture having a transport medium and feed materials which comprise the target feed material and the remaining feed materials, the target feed material being magnetic and generally having a higher specific gravity than any magnetic feed materials contained in the remaining feed materials, the separating apparatus comprising:

a gravity separator including a separation area on which to flow the feed mixture, the separation area including a magnetic separator material thereon to achieve a substantially uniformly thick layer to provide a magnetic field producing a sufficiently high magnetic attraction to enhance separation of the target feed material from the remaining feed materials in the feed mixture as the feed mixture flows over the separation area carrying the remaining materials past the separation area, the magnetic attraction of the magnetic field provided by the magnetic separator material on the separation area being sufficiently low to at least substantially avoid accumulating magnetic feed materials contained in the feed mixture on the separation area.

2. The separating apparatus of claim 1 wherein the magnetic separator material on the separation area is formed by attaching a magnetic layer on the separation area.

3. The separating apparatus of claim 2 wherein the magnetic layer comprises a flexible magnetic sheet.

4. The separating apparatus of claim 1 wherein the magnetic layer comprises a magnetic ceramic material.

5. The separating apparatus of claim 1 wherein the magnetic separator material on the separation area is formed by coating the separation area with a magnetic coating.

6. The separating apparatus of claim 1 wherein the remaining feed material substantially comprises a non-magnetic material having generally a lower specific gravity than the target feed material.

7. The separating apparatus of claim 1 wherein the feed materials comprise a magnetic feed material which is paramagnetic or ferromagnetic.

8. The separating apparatus of claim 1 wherein the magnetic separator material on the separation area has a thickness of about 0.5 to about 3 millimeters.

9. The separating apparatus of claim 8 wherein the magnetic separator material on the separation area has a thickness of about 0.5 to about 1 millimeter.

10. The separating apparatus of claim 1 wherein the separator is selected from the group of separators consisting of launder separators, spiral separators, cone separators, shaker tables, lamella separators, and hydroseparators.

11. The separating apparatus of claim 1 wherein the separator includes a discharge port disposed in a flow path of the target feed material for discharging the target feed material which is separated from the remaining feed materials being carried past the separator surface.

12. The separating apparatus of claim 1 wherein the separator comprises a metal or a non-metal material.

13. A magnetically enhanced gravity separating apparatus for enhancing separation of a target feed material from remaining feed materials in a feed mixture having a transport medium and feed materials which comprise the target feed material and the remaining feed materials, the target feed material being magnetic and generally having a higher specific gravity than any magnetic feed materials contained in the remaining feed materials, the separating apparatus comprising:

a gravity separator including a separation area on which to flow the feed mixture, the separation area including a magnetic separator material thereon to provide a magnetic field producing a sufficiently high magnetic attraction to enhance separation of the target feed material from the remaining feed materials in the feed mixture as the feed mixture flows over the separation area carrying the remaining materials past the separation area, the magnetic attraction of the magnetic field provided by the magnetic separator material on the separation area being sufficiently low to at least substantially avoid accumulating magnetic feed materials contained in the feed mixture on the separation area, wherein the magnetic separator material on the separation area is formed by coating the separation area with a magnetic coating, wherein the magnetic coating comprises a ceramic paint.

14. A magnetically enhanced gravity separating apparatus for enhancing separation of a target feed material from remaining feed materials in a feed mixture having a transport medium and feed materials which comprise the target feed material and the remaining feed materials, the target feed material being magnetic and generally having a higher specific gravity than any magnetic feed materials contained in the remaining feed materials, the separating apparatus comprising:

a gravity separator including a separation area on which to flow the feed mixture, the separation area including a magnetic separator material thereon to provide a magnetic field producing a sufficiently high magnetic attraction to enhance separation of the target feed material from the remaining feed materials in the feed mixture as the feed mixture flows over the separation area carrying the remaining materials past the separation area, the magnetic attraction of the magnetic field provided by the magnetic separator material on the separation area being sufficiently low to at least substantially avoid accumulating magnetic feed materials contained in the feed mixture on the separation area, wherein the magnetic separator material on the separation area is formed by coating the separation area with a magnetic coating, wherein the separation area is coated with the magnetic coating by painting or spraying the magnetic coating onto the separation area.

15. A magnetically enhanced gravity separating apparatus for enhancing separation of a target feed material from remaining feed materials in a feed mixture having a transport medium and feed materials which comprise the target feed material and the remaining feed materials, the target feed material being magnetic and generally having a higher specific gravity than any magnetic feed materials contained in the remaining feed materials, the separating apparatus comprising:

a gravity separator including a separation area on which to flow the feed mixture, the separation area including a magnetic separator material thereon to provide a magnetic field producing a sufficiently high magnetic attraction to enhance separation of the target feed material from the remaining feed materials in the feed mixture as the feed mixture flows over the separation area carrying the remaining materials past the separation area, the magnetic attraction of the magnetic field provided by the magnetic separator material on the separation area being sufficiently low to at least substantially avoid accumulating magnetic feed materials contained in the feed mixture on the separation area, wherein the magnetic separator material on the separation area is formed by coating the separation area with a magnetic coating, wherein the separation area is coated with the magnetic coating by thermal spraying the magnetic coating onto the separation area.

16. A magnetically enhanced gravity separating apparatus for enhancing separation of a target feed material from remaining feed materials in a feed mixture having a transport medium and feed materials which comprise the target feed material and the remaining feed materials, the target feed material being magnetic and generally having a higher specific gravity than any magnetic feed materials contained in the remaining feed materials, the separating apparatus comprising:

a gravity separator including a separation area on which to flow the feed mixture, the separation area including a magnetic separator material formed thereon prior to flowing the feed mixture thereover to achieve a substantially uniformly thick layer to provide a magnetic field producing a sufficiently high magnetic attraction to enhance separation of the target feed material from the remaining feed materials in the feed mixture as the feed mixture flows over the separation area carrying the remaining materials past the separation area.

17. The separating apparatus of claim 16 wherein the magnetic attraction of the magnetic field provided by the, magnetic separator material on the separation area is sufficiently low to at least substantially avoid accumulating magnetic feed materials contained in the feed mixture on the separation area.

18. The separating apparatus of claim 16 wherein the separation area is formed by lining the surface of the separator with a magnetic layer.

19. The separating apparatus of claim 16 wherein the separation area is formed by coating the surface of the separator with the magnetic separation material.

20. The separating apparatus of claim 16 wherein the separator includes a discharge port disposed in a flow path of the target feed material for discharging the target feed material which is separated from the remaining feed materials being carried past the separator surface.

21. A method for enhancing separation of a target feed material from remaining feed materials in a feed mixture having a transport medium and feed materials which comprise the target feed material and the remaining feed materials, the target feed material being magnetic and generally having a higher specific gravity than any magnetic feed materials contained in the remaining feed materials, the method comprising:

providing a gravity separator including a separation area having a magnetic separator material to achieve a substantially uniformly thick layer to provide a magnetic field producing a sufficiently high magnetic attraction to enhance separation of the target feed material from the remaining feed materials in the feed mixture as the feed mixture flows over the separation area carrying the remaining materials past the separation area the magnetic attraction of the magnetic field provided by the magnetic separator material on the separation area being sufficiently low to at least substantially avoid accumulating magnetic feed materials contained in the feed mixture on the separation area; and flowing the feed mixture over the separation area.

22. The method of claim 21 further comprising providing the magnetic separator material on the separation area prior to flowing the feed mixture thereover.

23. The method of claim 21 wherein the magnetic separator material is formed on the separation area by attaching a preformed magnetic layer on the separation area.

24. The method of claim 21 wherein the magnetic separator material is formed on the separation area by coating the separation area with the magnetic separator material prior to flowing the feed mixture thereover.

25. A method for enhancing separation of a target feed material from remaining feed materials in a feed mixture having a transport medium and feed materials which comprise the target feed material and the remaining feed materials, the target feed material being magnetic and generally having a higher specific gravity than any magnetic feed materials contained in the remaining feed materials, the method comprising:

providing a gravity separator including a separation area having a magnetic separator material to provide a magnetic field producing a sufficiently high magnetic attraction to enhance separation of the target feed material from the remaining feed materials in the feed mixture as the feed mixture flows over the separation area carrying the remaining materials past the separation area, the magnetic attraction of the magnetic field provided by the magnetic separator material on the separation area being sufficiently low to at least substantially avoid accumulating magnetic feed materials contained in the feed mixture on the separation area; and flowing the feed mixture over the separation area, wherein the magnetic separation material is coated onto the separation area by painting, spraying, lining, or thermal spraying.

* * * * *